United States Patent [19]

Kemp

[11] 3,981,631

[45] Sept. 21, 1976

[54] COMPRESSOR HEAD CONSTRUCTION

[75] Inventor: Donald P. Kemp, Stevensville, Mich.

[73] Assignee: Gast Manufacturing Corporation, Benton Harbor, Mich.

[22] Filed: Jan. 16, 1974

[21] Appl. No.: 433,820

[52] U.S. Cl. ..... 417/312; 417/313; 417/454; 417/571

[51] Int. Cl.[2] ..... F04B 21/00; F04B 39/00

[58] Field of Search ..... 417/312, 313, 571, 454, 417/413; 181/57, 61

[56] References Cited

UNITED STATES PATENTS

| | | | |
|---|---|---|---|
| 1,310,722 | 7/1919 | Warnock | 181/57 |
| 1,704,513 | 3/1929 | Pfeifer | 417/571 |
| 2,200,222 | 5/1940 | Tarleton | 417/312 |
| 2,253,206 | 8/1941 | Farrow | 417/413 |
| 3,220,639 | 11/1965 | Chew | 417/312 |
| 3,375,972 | 4/1968 | Raufeisen | 417/571 |
| 3,478,956 | 11/1969 | Gosha | 417/571 |
| 3,504,762 | 4/1970 | Valbjorn et al. | 181/57 |
| 3,524,388 | 8/1970 | Enemark | 417/312 |
| 3,530,649 | 9/1970 | Porsch et al. | 181/57 |
| 3,650,639 | 3/1972 | Greene | 417/312 |
| 3,698,840 | 10/1972 | Hover | 417/312 |
| 3,771,911 | 11/1973 | Turci | 417/413 |
| 3,817,661 | 6/1974 | Ingalls | 417/312 |
| 3,825,374 | 5/1972 | Kondo | 417/413 |
| 3,847,513 | 11/1974 | Foster | 417/571 |

FOREIGN PATENTS OR APPLICATIONS

| | | | |
|---|---|---|---|
| 1,298,728 | 9/1960 | France | 417/413 |
| 1,236,367 | 6/1960 | France | 417/413 |
| 1,378,188 | 10/1964 | France | 417/413 |
| 199,983 | 7/1922 | United Kingdom | 181/61 |

*Primary Examiner*—William L. Freeh
*Attorney, Agent, or Firm*—Price, Heneveld, Huizenga & Cooper

[57] ABSTRACT

An integrally cast compressor head includes an air inlet port communicating with a first configurated channel having filter means therein, which channel communicates with a one-way valve coupled to the surface of the head forming the top of the compressor chamber when the head is positioned on a cylinder. The integral head construction further includes a one-way outlet valve communicating with a second channel including a filter element, and an outlet port permitting pressurized air in the compressor chamber to exit therethrough. The improved compressor head construction includes a removable cover plate in sealed engagement with one side of the channels and filter means to permit ready access to the filter elements and the valves without removing the head from the compressor cylinder.

3 Claims, 5 Drawing Figures

COMPRESSOR HEAD CONSTRUCTION

BACKGROUND OF THE INVENTION

The present invention relates to air compressors or vacuum pumps and particularly to an improved head construction for a diaphragm type compressor.

Low volume, relatively high pressure diaphragm vacuum pumps or compressors employ a resilient diaphragm forming a movable wall of a compression chamber and which travel a relatively short distance to draw air into the chamber through a one-way valve and on the upward stroke of the rod coupled to the diaphragm, compress the charge of air and force it through a one-way outlet valve. In known compressors, a floating valve plate construction has been employed in which a separate plate which houses the inlet and outlet valves is positioned above the diaphragm and a separate compressor head is positioned over the valve plate. The compressor head includes, in some instances, filter means for filtering air as it enters and exits the compressor.

This conventional diaphragm compressor construction is relatively complex and expensive as it requires a separate valve plate and compressor head. Additionally, such construction prevents ready access to the valves and filter means employed with the compressor should they require maintenance.

SUMMARY OF THE INVENTION

The compressor head construction of the present invention, however, is shaped to accommodate both the inlet and outlet valves and configurated channels and filter receiving means communicating between the valves and inlet and outlet ports. The channels and filter receiving means formed within the head casting are open at one end and the casting is configurated to receive a cover plate which is removably and sealably coupled to the head to enclose the channels. Such construction eliminates the relatively complex and, therefore, costly floating valve plate previously employed and permits ready access to the filters and the valves.

An object of the present invention, therefore, is to provide an integral compressor head and valve construction.

A further object of the present invention is to provide a compressor head with a removable cover permitting access to filter means positioned in the head.

Still a further object of the present invention is to provide a compressor head for a diaphragm type vacuum pump or compressor which includes configurated channels to reduce the noise of operation of the compressor.

These and other objects of the present invention will become apparent upon reading the following description thereof together with the drawings in which:

DETAILED DESCRIPTION OF THE PREFERRED EMBODIMENT

Figure 1:
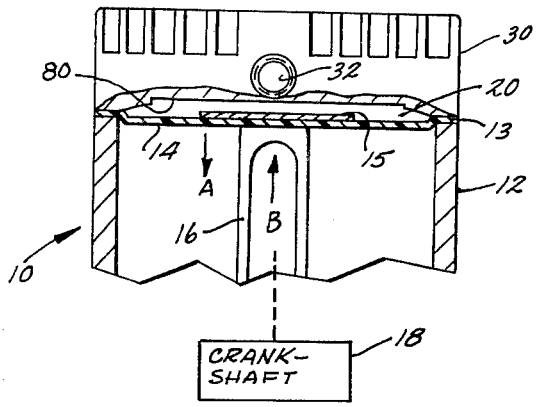
FIG. 1 is a fragmentary, side elevational view of the diaphragm compressor embodying the present invention shown partly broken away and in cross section.

Referring now to FIG. 1, there is shown a diaphragm type compressor 10 including a compressor cylinder 12 in which there is disposed a resilient diaphragm 14 made of neoprene or other suitable rubber or resilient polymeric material. The diaphragm is actuated by means of a piston rod 16 mechanically coupled to a crank shaft 18 (shown schematically in FIG. 1) which in turn is driven by an electrical motor or other suitable motive means. Diaphragm 14 is coupled to piston rod 16 by means of a backing plate 15 and conventional fastening means such as bolts or the like which extend through the backing plate into the end of the piston rod 16 thereby securing the diaphragm therebetween.

Diaphragm 14 moves downwardly, as indicated by arrow A, to draw air into a compression chamber 20 through an inlet port 32 in a compressor head assembly 30. As the piston rod moves upwardly in a direction indicated by arrow B, the charge of air in chamber 20 is compressed and forced outwardly through outlet port 36 in the head assembly 30. The head assembly 30 is bolted to the cylinder 12 by means of conventional bolts (not shown) such that the peripheral edge of the diaphragm 14 is compressibly held between the rim 13 of the cylinder wall 12 and a mating sealing surface of the cylinder head assembly. Unit 10 can be employed either as a compressor where pressurized air is supplied through outlet port 36 or as a vacuum pump where inlet port 32 is coupled to a vessel to be evacuated. The improved compressor head assembly 30 is now described in detail with reference to FIGS. 2–5.

Figure 2:
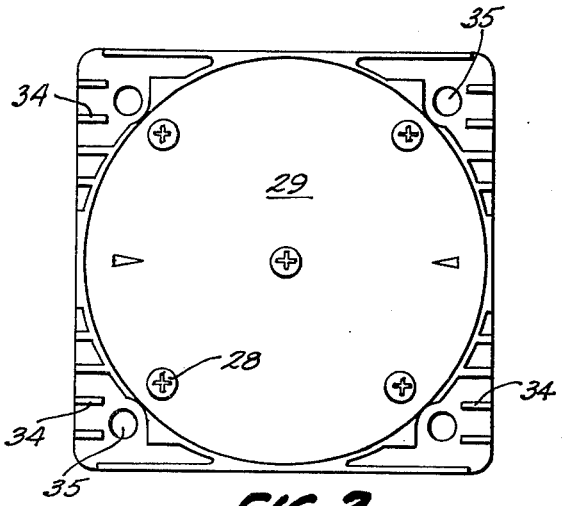
FIG. 2 is a top plan view of the compressor head shown in FIG. 1 with the inlet port shown in FIG. 1 on the left side of the head as seen in FIG. 2.
Figure 3:
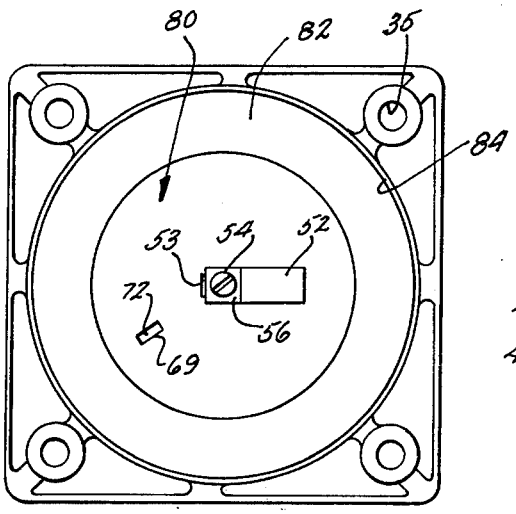
FIG. 3 is a bottom plan view of the head assembly shown in FIG. 2.
Figure 4:
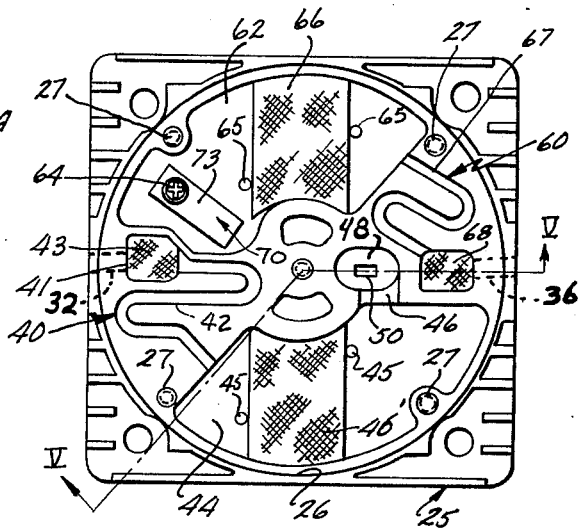
FIG. 4 is a top plan view of the head assembly shown in FIG. 2 with the cover plate and a seal removed.
Figure 5:
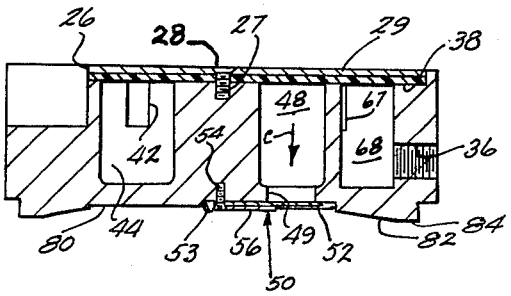
FIG. 5 is a cross section of the head assembly taken along the section lines V—V in FIG. 4 shown with the cover plate and seal in place.

As best seen in FIGS. 2, 4 and 5, the head assembly comprises a casting 25 of die cast aluminum in the preferred embodiment and which includes a circular cover receiving recess 26 formed downwardly into the top of the casting. The head can, of course, be cast of other suitable materials and can be formed other than by casting. For example, the head could be manufactured by forging or impact forming. A plurality of threaded apertures 27 are provided to receive fastening screws 28 for securing the circular cover plate 29 and seal 38 within recess 26. The head is substantially rectangular with spaced cooling fins 34 extending from the casting at the corners as seen in FIGS. 1, 2 and 4. Corner apertures 35 are provided to receive bolts for attaching the head to the cylinder as seen in FIG. 1.

Formed downwardly through the top of the casting, as best seen in FIG. 4, and within the recess for the cover plate 29, is a complex first channel 40 which communicates between the inlet port 32 and a one-way inlet valve 50. Channel 40 includes a first chamber 41, a second chamber 44, a channel 42 coupling these chambers, and a valve port 46 and chamber 48 for an inlet valve 50. The relatively small chamber 41 communicates directly with the interior end of inlet port 32, which chamber extends downwardly into the head casting approximately 8/10 the distance from the top of the casting. A filter media 43 is inserted into chamber 41 as seen in FIG. 4. Extending from chamber 41 is the substantially S-curved, open-ended channel or lead tube 42 which extends downwardly into the casting approximately midway as best seen in FIG. 5. Channel 42 provides a communication path between chamber 41 and the arcuate-shaped filter chamber 44. A pair of spaced posts 45 extend upwardly from the floor of chamber 44 for securing therein a filter media 46'. Filter mediae 43 and 45' areopen cell foam polymeric material such as polyurethane which is commercially available and freely permits the flow of air therethrough.

Filter chamber 44 extends significantly downwardly into the casting as best seen in FIG. 5. On the end of chamber 44 remote from channel 42 there is formed a port 46 which communicates with a first valve chamber 48. A rectangular aperture 49 is formed through the floor of chamber 48 and forms a valve seat for the unidirectional inlet valve 50 as best seen in FIG. 5. Thus, the inlet channel 40, when covered by plate 29, provides a communication path between the inlet port 32 and the valve 50 through filter media 43 fitted in chamber 41 and filter media 46' in chamber 44. The lead channel 42 is configurated to add to the overall length of the channel portion between port 36 and chamber 44 while the shape and size of chamber 44, when combined with channel 42, provides a tuning effect tending to reduce the noise of operation of the compressor particularly in the mid-frequency range of approximately 500 Hz. Channel 42 is S-shaped in the preferred embodiment but can take any desired path to elongate the channel. The filter media serves the primary purpose of filtering the air entering the compression chamber and also dampens the noise of operation. It is noted here that some compressors will not require filters. Also, it is possible if desired to filter the air by means external to the compressor.

Valve 50 comprises a rectangular reed plate 52 of 0.003 inch stainless steel which is secured to the casting at one end by means of a screw 54 and backing plate 56 as seen in FIG. 5. The reed 52 fits snugly against the outer or bottom face of the valve seat against a raised rib 53 (FIG. 3) to effectively seal opening 49 as best seen in FIG. 5. Reed 52 will deflect downwardly to permit air to be drawn into the compression chamber 20 (FIG. 1) as diaphragm 14 moves downwardly such that air will be drawn into the chamber through channel means 40 and check valve 50 into the chamber during the intake stroke of the compressor.

The casting includes a complex outlet channel means 60 including an outlet valve and filter chamber 62 and an S-shaped lead chamber 67 coupling chamber 62 to a chamber 68 communicating with outlet port 36. Chamber 62 is formed downwardly into the casting and is of significantly the same shape and depth as chamber 44 but on the opposite side of the casting as best seen in FIG. 4. Fitted within chamber 62 is an outlet valve 70 covering a rectangular port 69 (FIG. 3) which is formed through the floor of the chamber. Chamber 62 includes a pair of posts 65 extending upwardly for securing a filter media 66 as seen in FIG. 4. At the end of chamber 62 opposite valve 70 there is formed an S-shaped lead channel 67 extending downwardly approximately midway through the casting as best seen in FIG. 5, and communicating at its end remote from chamber 62 with an outlet chamber 68. Chamber 68 communicates directly with a threaded outlet port 36.

One-way valve 70 forming the outlet valve comprises a reed member 72 (FIG. 3) substantially the same as member 52 which covers the aperture 69 and is secured at one end to the floor of chamber 62 by means of an elongated rectangular backing plate 73 (FIG. 4) and fastening screw 64. Thus, the outlet channel 60 communicates between the compression chamber 20, through port 69, valve 70 and through the chamber 60 to outlet port 36 when cover plate 29 is in position on the head. As the diaphragm 14 moves upwardly in the direction indicated by arrow B during the compression stroke, the charge of air received during the intake stroke is compressed and deflects reed 72 away from port 69 permitting the discharge of the air through outlet channel 60 and port 36. Backing plate 73 is spaced from reed 72 to permit it to deflect to open port 69 without permitting excess deflection which could cause fluttering of the reed.

Like inlet channel 40, the chambers and channels of outlet channel 60 are configurated to permit filter media to be removably inserted therein for filtering the air passing through the compressor as well as reducing the noise of operation of the compressor. It is noted that each of the chambers and channels coupling the chambers is open at the top end, as best seen in FIGS. 4 and 5, and have top surfaces lying in substantially the same plane as best seen in FIG. 5. This permits the cover plate 29 to be placed thereover with a circular resilient seal 38 placed directly over the channels and chambers to close the upper end of these members permitting air flow through said head only between ports 32 and 36 and valves 50 and 70. Seal 38 is made of a resilient polymeric material such as neoprene. The elongated channel segments (42 and 67) are positioned between the inlet and outlet ports and the associated enlarged chambers (44, 62) which act as expansion chambers to aid in reducing the noise of operation of the compressor. Also, the elongated channel segments serve to isolate the compressor chamber from the inlet and outlet ports of the compressor.

The bottom surface of the casting includes a centrally recessed circular area 80 forming the top of the compression chamber as best seen in FIGS. 1 and 5. Side walls 82 curve downwardly and outwardly from the circular recess 80 to a peripheral flange 84 which, as best seen in FIG. 5, is substantially flat and provides a mating sealing surface for rim 13 of the cylinder 12 such that when the head is bolted to the cylinder, the diaphragm is securely held in place and seals the head to the cylinder.

It will become apparent to those skilled in the art that various modifications to the preferred embodiment can be made without departing from the spirit or scope of the invention defined by the appended claims.

The embodiments of the invention in which an exclusive property or privilege is claimed are defined as follows:

1. A compressor head construction comprising:

a head adapted to be attached to a compressor cylinder and including a surface defining a wall of the compression chamber of said cylinder;

inlet and outlet ports formed in said head;

first channel means formed in said head on a side opposite said surface defining a wall of the compression chamber and first aperture means extending through said head for coupling said inlet port to said compression chamber adjacent an opposite side of said casting, said first channel means including an elongated, generally S-shaped portion coupled at one end to said inlet port, an enlarged filter receiving portion having a depth greater than said elongated portion and coupled at one end for said elongated portion and further including filter means disposed in said enlarged portion for filtering air entering said compression chamber;

second channel means formed in said head on a side opposite said surface defining a wall of the compression chamber and second aperture means extending through said head for coupling said compression chamber to said outlet port;

cover means removably secured only to said head to permit access to said filter means and for sealably covering said first and second channel means; and valve means coupled to said head to permit air to be compressed to enter said compressor only through said inlet port and exit said compressor only through said outlet port.

2. The apparatus as defined in claim 9 wherein said second channel means includes an elongated generally S-shaped portion coupled at one end to said outlet port and an enlarged outlet filter receiving chamber having a depth greater than said elongated portion and coupled at one end to said elongated portion.

3. A compressor head construction comprising:

a head adapted to be attached to a compressor cylinder and including a surface defining a wall of the compression chamber of said cylinder;

inlet and outlet ports formed in said head;

first channel means formed in said head from one side thereof for coupling said inlet port to said compression chamber adjacent an opposite side of said casting, said first channel means including filter means for filtering air entering said compression chamber;

second channel means formed in said head from said one side for coupling said compression chamber to said outlet port; and removable cover means for sealably covering said first and second channel means to permit air to be compressed to enter said compressor only through said inlet port and exit said compressor only through said outlet port to permit access to said filter means, and wherein said first channel means includes an elongated portion and an enlarged inlet filter receiving chamber, wherein said second channel means includes an elongated portion and an enlarged outlet filter receiving chamber, wherein said second channel includes filter means positioned in said outlet filter receiving chamber, and wherein said filter means for said first and second channel means comprises an open cell polymeric material.

* * * * *

UNITED STATES PATENT AND TRADEMARK OFFICE

CERTIFICATE OF CORRECTION

PATENT NO. : 3,981,631

DATED : September 21, 1976

INVENTOR(S) : Donald P. Kemp

It is certified that error appears in the above-identified patent and that said Letters Patent are hereby corrected as shown below:

Column 3, line 5:

"46'" should be --- 45' ---.

Column 5, line 16, Claim 2:

"9" should be --- 1 ---.

Signed and Sealed this

First Day of February 1977

[SEAL]

*Attest:*

RUTH C. MASON
*Attesting Officer*

C. MARSHALL DANN
*Commissioner of Patents and Trademarks*